US010908521B2

(12) United States Patent
Mitsuda et al.

(10) Patent No.: US 10,908,521 B2
(45) Date of Patent: Feb. 2, 2021

(54) ELECTROPHOTOGRAPHIC PHOTOCONDUCTOR, PROCESS CARTRIDGE, AND ELECTROPHOTOGRAPHIC APPARATUS

(71) Applicant: CANON KABUSHIKI KAISHA, Tokyo (JP)

(72) Inventors: Haruhiko Mitsuda, Nagareyama (JP); Tatsuya Ikezue, Toride (JP); Kumiko Takizawa, Saitama (JP); Kan Tanabe, Matsudo (JP); Ikuyo Kuroiwa, Tokyo (JP); Takanori Ueno, Nagareyama (JP); Tsuyoshi Shimada, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/660,611

(22) Filed: Oct. 22, 2019

(65) Prior Publication Data

US 2020/0133150 A1 Apr. 30, 2020

(30) Foreign Application Priority Data

Oct. 25, 2018 (JP) ..... 2018-201212

(51) Int. Cl.

| | |
|---|---|
| ***G03G 5/00*** | (2006.01) |
| ***G03G 5/14*** | (2006.01) |
| ***G03G 5/06*** | (2006.01) |
| ***G03G 15/00*** | (2006.01) |
| ***G03G 21/18*** | (2006.01) |
| ***G03G 5/05*** | (2006.01) |

(52) U.S. Cl.

CPC ..... *G03G 5/144* (2013.01); *G03G 5/0564* (2013.01); *G03G 5/0605* (2013.01); *G03G 5/0618* (2013.01); *G03G 15/75* (2013.01); *G03G 21/1814* (2013.01)

(58) Field of Classification Search

CPC ..... G03G 5/144
USPC ..... 430/60, 63, 65
See application file for complete search history.

(56) References Cited

U.S. PATENT DOCUMENTS

2018/0120716 A1* 5/2018 Takamura ..... G03G 5/0672

FOREIGN PATENT DOCUMENTS

| | | | |
|---|---|---|---|
| JP | 3-284759 | A | 12/1991 |
| JP | 2005-242155 | A | 9/2005 |
| JP | 2006-178415 | A | 7/2006 |
| JP | 4615449 | B2 | 1/2011 |
| JP | 5123621 | B2 | 1/2013 |
| JP | 2015-210477 | A | 11/2015 |

* cited by examiner

*Primary Examiner* — Mark A Chapman
(74) *Attorney, Agent, or Firm* — Canon U.S.A., Inc. IP Division

(57) ABSTRACT

An electrophotographic photoconductor includes, in sequence, a support member; an undercoating layer containing a binder resin and an inorganic particle; and a photosensitive layer, wherein the binder resin of the undercoating layer is an alkyd-melamine resin, and the inorganic particle of the undercoating layer contains a strontium titanate particle.

10 Claims, 1 Drawing Sheet

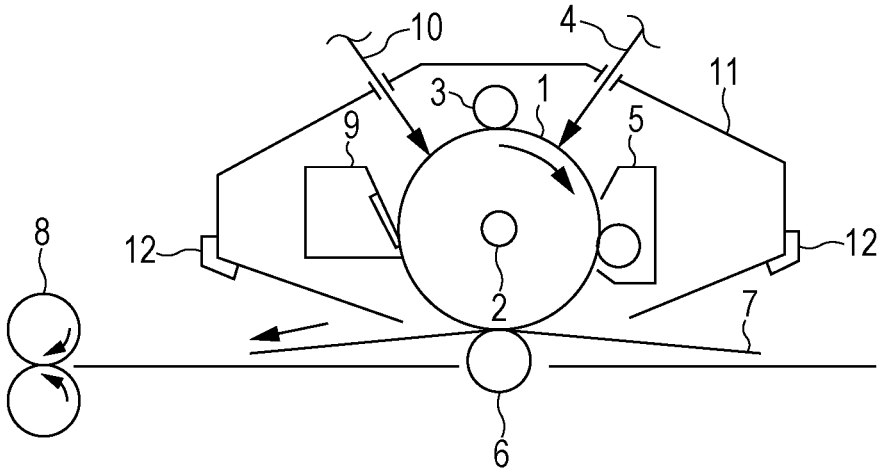
10
4
3
1
11
9
5
8
12
12
2
7
6

ELECTROPHOTOGRAPHIC PHOTOCONDUCTOR, PROCESS CARTRIDGE, AND ELECTROPHOTOGRAPHIC APPARATUS

BACKGROUND OF THE INVENTION

Field of the Invention

The present disclosure relates to an electrophotographic photoconductor, and a process cartridge and an electrophotographic apparatus that include the electrophotographic photoconductor.

Description of the Related Art

In recent years, organic electrophotographic photoconductors (hereafter, referred to as "electrophotographic photoconductors") have been employed that are electrophotographic photoconductors having an undercoating layer containing a binder resin and an inorganic particle, and a photosensitive layer formed on the undercoating layer. As the binder resin of the undercoating layer of such an electrophotographic photoconductor, from the viewpoint of, for example, electrical characteristics and film formability, a resin containing an alkyd resin in combination with a melamine resin serving as a crosslinking agent (hereafter, referred to as alkyd-melamine resin) is widely used; and an undercoating layer has been proposed that contains the alkyd-melamine resin as the binder and an inorganic particle of titanium oxide or the like. Japanese Patent No. 5123621 describes an electrophotographic photoconductor having an undercoating layer containing a binder resin, a rutile-type titanium oxide fine particle having an average particle diameter of 0.1 μm or more and 1.0 μm or less, and an anatase-type titanium oxide fine particle having an average particle diameter of 0.01 μm or more and 0.05 μm or less. Japanese Patent No. 4615449 describes a method for producing an electrophotographic photoconductor including a step of forming an intermediate layer in which a coating liquid containing titanium oxide, an alkyd-melamine resin, and a solvent at least including ethylene glycol monoisopropyl ether is applied and then dried; and the electrophotographic photoconductor produced by the production method.

SUMMARY OF THE INVENTION

An electrophotographic photoconductor according to an embodiment of the present disclosure includes, in sequence, a support member, an undercoating layer containing a binder resin and an inorganic particle, and a photosensitive layer, wherein the binder resin of the undercoating layer is an alkyd-melamine resin, and the inorganic particle of the undercoating layer contains a strontium titanate particle.

Further features of the present disclosure will become apparent from the following description of exemplary embodiments with reference to the attached drawing.

BRIEF DESCRIPTION OF THE DRAWING

The FIGURE illustrates the configuration of layers of an electrophotographic photoconductor according to an embodiment of the present disclosure.

DESCRIPTION OF THE EMBODIMENTS

The inventors of the present disclosure have found that repeated use of the electrophotographic photoconductors described in Japanese Patent Nos. 5123621 and 4615449 results in an increase in the residual potential in some cases.

The present disclosure provides an electrophotographic photoconductor in which the increase in the residual potential due to repeated use is suppressed.

Hereinafter, the present disclosure will be described in detail with reference to some embodiments.

The inventors of the present disclosure studied such undercoating layers including an alkyd-melamine resin as the binder resin, and inferred that unreacted hydroxy groups of the alkyd-melamine resin become trap sites for charges, so that repeated use results in the increase in the residual potential. The inventors sought an inorganic particle suitable for such an undercoating layer containing an alkyd-melamine resin and an inorganic particle, and have found that a strontium titanate particle contained as the inorganic particle enables suppression of the increase in the residual potential due to repeated use. The mechanism of providing this advantage has not been clarified; however, the inventors infer that a strong interaction between the surface of the strontium titanate particle and the hydroxy groups of the alkyd-melamine resin provides conductivity, which results in release of trapped charges.

Electrophotographic Photoconductor

An electrophotographic photoconductor according to an embodiment of the present disclosure includes a support member, and, in sequence, at least an undercoating layer and a photosensitive layer on the support member, wherein the undercoating layer contains a binder resin and an inorganic particle, the binder resin is an alkyd-melamine resin, and the inorganic particle contains a strontium titanate particle.

A method for producing the electrophotographic photoconductor according to an embodiment of the present disclosure may be a method of preparing coating liquids for layers described later, applying the coating liquids in the predetermined order of stacking the layers, and drying the coating liquids. Examples of the process of applying the coating liquids include immersion coating, spray coating, ink jet coating, roll coating, die coating, blade coating, curtain coating, wire bar coating, and ring coating. Of these, from the viewpoint of efficiency and productivity, immersion coating can be employed.

Hereinafter, the layers will be individually described.

Support Member

In this embodiment of the present disclosure, the electrophotographic photoconductor includes a support member. In this embodiment of the present disclosure, the support member can be a conductive support member having conductivity. The support member may have a shape, for example, a cylindrical shape, a belt shape, or a sheet shape. Of these, the support member may have a cylindrical shape. The surface of the support member may be treated by, for example, an electrochemical treatment such as anodic oxidation, blasting, or grinding.

The support member may be formed of, for example, metal, resin, or glass. Examples of the metal include aluminum, iron, nickel, copper, gold, stainless steel, and alloys of the foregoing. In particular, an aluminum support member formed of aluminum may be used. Alternatively, in the case of using resin or glass, for example, the resin or glass may be mixed with or covered with a conductive material, to thereby impart conductivity.

Charge Blocking Layer

In this embodiment of the present disclosure, the electrophotographic photoconductor may include a charge blocking layer disposed on the support member and composed of an insulating binder resin. The charge blocking layer enables improvements in the charge injection blocking function and improvements in the effect of masking scratches and unevenness in the surface of the support member. Examples of the binder resin for the charge blocking layer include polyamide resins, N-methoxymethylated nylon resins, and copolymerized nylon resins. In the case of forming the charge blocking layer, the charge blocking layer may be formed so as to have a thickness of 0.05 μm or more and 1 μm or less.

Undercoating Layer

In this embodiment of the present disclosure, the electrophotographic photoconductor includes an undercoating layer on the support member or the charge blocking layer. In this embodiment of the present disclosure, the undercoating layer contains a binder resin and an inorganic particle; the binder resin is an alkyd-melamine resin; and the inorganic particle at least contains a strontium titanate particle.

In this embodiment of the present disclosure, the strontium titanate particle contained in the undercoating layer preferably has an average primary particle diameter of 10 nm or more and 300 nm or less, more preferably 10 nm or more and 100 nm or less. When the average primary particle diameter is more than 300 nm, the effect of suppressing an increase in the residual potential during repeated use of the electrophotographic photoconductor may not be sufficiently exerted. When the average primary particle diameter is less than 10 nm, the particle in the undercoating-layer-forming coating liquid may have lower dispersibility, so that the undercoating layer may be formed with lower film formability, and output images may have coarseness.

In the undercoating layer, the mass ratio of the amount of the strontium titanate particle to the total amount of the inorganic particle is preferably 0.6 or more and 1.0 or less, more preferably 0.8 or more and 1.0 or less. When the mass ratio of the amount of the strontium titanate particle to the total amount of the inorganic particle contained in the undercoating layer is less than 0.6, the effect of suppressing an increase in the residual potential during repeated use of the electrophotographic photoconductor may not be sufficiently exerted.

In this embodiment of the present disclosure, in the alkyd-melamine resin contained in the undercoating layer, the mass ratio of the amount of the melamine resin to the total amount of the alkyd resin in the alkyd-melamine resin is preferably 0.25 or more and 1.50 or less, more preferably 0.5 or more and 1.2 or less. When the mass content ratio of the melamine resin to the alkyd resin is more than 1.5, the effect of suppressing an increase in the residual potential during repeated use may not be sufficiently exerted. When the mass content ratio of the melamine resin to the alkyd resin is less than 0.25, the undercoating layer may have lower solvent resistance. For example, when the charge generating layer is formed by coating on the undercoating layer, the undercoating layer may be dissolved during the coating with the charge generating layer, so that the charge generating layer may not be evenly formed by coating and output images may have uneven densities.

In this embodiment of the present disclosure, the mass content ratio of the inorganic particle to the alkyd-melamine resin in the undercoating layer is preferably 2.0 or more and 9.0 or less, more preferably 2.0 or more and 6.0 or less. When the mass content ratio of the inorganic particle to the alkyd-melamine resin in the undercoating layer is more than 9.0, fine cracks may appear in the surface of the undercoating layer and cause image failure in the output images. When the mass content ratio of the inorganic particle to the alkyd-melamine resin in the undercoating layer is less than 2.0, the effect of suppressing an increase in the residual potential during repeated use of the electrophotographic photoconductor may not be sufficiently exerted.

In this embodiment of the present disclosure, the strontium titanate particle contained in the undercoating layer is preferably surface-treated with a surface treatment agent in order to exhibit higher dispersibility in the coating liquid to provide better electrical characteristics of the electrophotographic photoconductor, more preferably surface-treated with a silane coupling agent having at least one functional group species selected from the group consisting of alkyl groups, amino groups, and halogen groups.

The undercoating layer may contain an electron transport material for the purpose of providing better electrical characteristics. Examples of the electron transport material include quinone compounds, imide compounds, benzimidazole compounds, cyclopentadienylidene compounds, fluorenone compounds, xanthone compounds, benzophenone compounds, cyano vinyl compounds, halogenated aryl compounds, silole compounds, and boron-containing compounds. As the electron transport material, an electron transport material having a polymerizable functional group may be employed and copolymerized with the above-described monomer having a polymerizable functional group, to thereby form a cured film serving as the undercoating layer.

The undercoating layer may further contain an additive.

The undercoating layer can be formed by preparing an undercoating-layer-forming coating liquid containing the above-described materials and solvent, forming the coating film, and drying and/or curing the coating film. Examples of the solvent used for the coating liquid include alcohol-based solvents, ketone-based solvents, ether-based solvents, ester-based solvents, and aromatic hydrocarbon-based solvents.

Photosensitive Layer

In this embodiment of the present disclosure, on the undercoating layer, a photosensitive layer is disposed. The photosensitive layer may be a single-layer-type photosensitive layer containing both of a charge generating material and a charge transport material within the same layer, or a multi-layer-type photosensitive layer in which a charge generating layer containing a charge generating material and a charge transport layer containing a charge transport material are individually disposed. In this embodiment of the present disclosure, the multi-layer-type photosensitive layer may be employed.

In the case of employing the multi-layer-type photosensitive layer, the charge generating layer may be formed in the following manner—a charge generating material and a binder resin are mixed with a solvent, and subjected to a dispersion treatment; the resultant charge-generating-layer-forming coating liquid is applied to form a coating film; and this coating film is dried. Alternatively, the charge generating layer may be formed as a vapor-deposition film of the charge generating material.

Examples of the charge generating material used for the charge generating layer include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyes, anthanthrone pigments, pyranthrone pigments, xanthene dyes, quinoneimine dyes, and styryl dyes. Such charge generating materials may be used alone or in combination of two or more thereof. Among the charge generating materials, from the viewpoint of sensitivity, phthalocyanine pigments and azo pigments may be used, in particular, phthalocyanine pigments may be used.

Among phthalocyanine pigments, in particular, oxytitanium phthalocyanine, chlorogallium phthalocyanine, and hydroxygallium phthalocyanine exhibit high charge generating efficiency.

Examples of the binder resin used for the charge generating layer include polymers of vinyl compounds such as styrene, vinyl acetate, vinyl chloride, acrylate, methacrylate, vinylidene fluoride, and trifluoroethylene, polyvinyl alcohol resins, polyvinyl acetal resins, polycarbonate resins, polyester resins, polysulfone resins, polyphenylene oxide resins, polyurethane resins, cellulose resins, phenol resins, melamine resins, silicon resins, and epoxy resins.

The process of the dispersion treatment may be, for example, a process using a homogenizer, ultrasonic dispersion, a ball mill, a vibration ball mill, a sand mill, an attritor, or a roll mill.

Examples of the solvent used for the charge-generating-layer-forming coating liquid include alcohol-based solvents, sulfoxide-based solvents, ketone-based solvents, ether-based solvents, ester-based solvents, aliphatic halogenated hydrocarbon-based solvents, and aromatic compounds.

The charge generating layer preferably has a thickness of 0.01 μm or more and 5 μm or less, more preferably 0.1 μm or more and 1 μm or less. The charge generating layer may be formed so as to contain optionally various sensitizers, antioxidants, ultraviolet absorbers, and plasticizers.

Hereinafter, the charge transport layer will be described. The charge transport layer is formed on the charge generating layer. The charge transport layer can be formed in the following manner—a charge transport material and a binder resin are dissolved in a solvent; the resultant charge-transport-layer-forming coating liquid is applied to form a coating film; and the obtained coating film is dried.

Examples of the binder resin used for the charge transport layer include polyvinyl butyral, polycarbonate resins, polyester resins, phenoxy resins, polyvinyl acetate, acrylic resins, polyacrylamide, polyamide, polyvinyl pyridine, cellulose resins, urethane resins, and epoxy resins. Of these, polycarbonate resins may be used.

Examples of the charge transport material used for the charge transport layer include triarylamine compounds, hydrazone compounds, stilbene compounds, pyrazoline compounds, oxazole compounds, triallylmethane compounds, and thiazole compounds. Such charge transport materials may be used alone or in combination of two or more thereof.

In the charge transport layer, the charge transport material and the binder resin may be contained in the following ratio: relative to 1 part by mass of the binder resin, 0.3 parts by mass or more and 10 parts by mass or less of the charge transport material is contained.

From the viewpoint of suppressing cracking in the charge transport layer, the drying temperature is preferably 60° C. or more and 150° C. or less, more preferably 80° C. or more and 120° C. or less. The drying time may be 10 minutes or more and 60 minutes or less.

Examples of the solvent used for the charge-transport-layer-forming coating liquid include alcohol solvents, sulfoxide solvents, ketone solvents, ether solvents, ester solvents, aliphatic halogenated hydrocarbon solvents, and aromatic hydrocarbon solvents. The charge transport layer preferably has a thickness of 5 μm to 40 μm, in particular, more preferably 10 μm to 35 μm.

The charge transport layer may be formed so as to contain optionally an antioxidant, an ultraviolet absorber, a plasticizer, a metal oxide particle, an inorganic particle, a fluorine-atom-containing resin particle, or a silicone-containing resin particle, for example.

Of these, in particular, the compound represented by the following formula (1) may be contained in the charge transport layer.

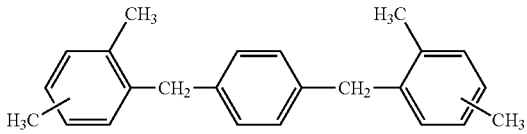

The compound of the formula (1) contained in the charge transport layer or the photosensitive layer suppresses variations in the light area potential in the surface of the electrophotographic photoconductor during repeated use, which results in better electrical characteristics.

Protective Layer

In this embodiment of the present disclosure, a protective layer may be disposed on the photosensitive layer. The protective layer provides higher durability.

The protective layer may contain a conductive particle and/or a charge transport material, and a resin.

Examples of the conductive particle include particles of metal oxides such as titanium oxide, zinc oxide, tin oxide, indium oxide, and alumina.

Examples of the charge transport material include polycyclic aromatic compounds, heterocyclic compounds, hydrazone compounds, styryl compounds, enamine compounds, benzidine compounds, triarylamine compounds, and resins having groups derived from the foregoing materials. Of these, triarylamine compounds and benzidine compounds may be used.

Examples of the resin include polyester resins, acrylic resins, phenoxy resins, polycarbonate resins, polystyrene resins, phenol resins, melamine resins, and epoxy resins. Of these, polycarbonate resins, polyester resins, and acrylic resins may be used.

The protective layer may be formed as a cured film by polymerizing a composition containing a monomer having a polymerizable functional group. In this case, the reaction may be a thermal polymerization reaction, a photopolymerization reaction, or a radiation polymerization reaction, for example. Examples of the polymerizable functional group of the monomer having a polymerizable functional group include an acryloyl group and a methacryloyl group. The monomer having a polymerizable functional group may be a material having a charge transport capability.

The protective layer may be formed so as to contain an additive such as an antioxidant, an ultraviolet absorber, a plasticizer, a leveling agent, a lubricity-imparting agent, or a wear resistance improver. Specific examples include hindered phenol compounds, hindered amine compounds, sulfur compounds, phosphorus compounds, benzophenone compounds, siloxane-modified resins, silicone oil, fluororesin particles, polystyrene resin particles, polyethylene resin particles, silica particles, alumina particles, and boron nitride particles.

The protective layer may have an average thickness of 0.5 μm or more and 10 μm or less.

The protective layer can be formed in the following manner—a protective-layer-forming coating liquid containing the above-described materials and solvent is prepared;

this coating liquid is used to form a coating film, and the coating film is dried and/or cured. Examples of the solvent used for the coating liquid include alcohol-based solvents, ketone-based solvents, ether-based solvents, sulfoxide-based solvents, ester-based solvents, and aromatic hydrocarbon-based solvents.

Process Cartridge and Electrophotographic Apparatus

A process cartridge according to an embodiment of the present disclosure collectively supports the above-described electrophotographic photoconductor, and at least one unit selected from the group consisting of a charging unit, a developing unit, a transfer unit, and a cleaning unit, and is configured to be detachably attached to the main body of an electrophotographic apparatus.

An electrophotographic apparatus according to an embodiment of the present disclosure includes the above-described electrophotographic photoconductor, a charging unit, an exposure unit, a developing unit, and a transfer unit.

FIGURE illustrates an example of the schematic configuration of the electrophotographic apparatus including a process cartridge including an electrophotographic photoconductor.

An electrophotographic photoconductor 1 has a cylindrical shape and is driven to rotate around a shaft 2 in a direction represented by arrow at a predetermined circumferential velocity. The surface of the electrophotographic photoconductor 1 is charged, by a charging unit 3, to a predetermined positive or negative potential. Incidentally, FIGURE illustrates a roller charging type using a roller charging member; alternatively, another charging type may be employed such as a corona charging type, a proximity charging type, or an injection charging type. The charged surface of the electrophotographic photoconductor 1 is irradiated with exposure light 4 emitted from an exposure unit (not shown), to form an electrostatic latent image corresponding to the target image information. The electrostatic latent image formed on the surface of the electrophotographic photoconductor 1 is developed with toner accommodated within a developing unit 5, to form a toner image on the surface of the electrophotographic photoconductor 1. The toner image formed on the surface of the electrophotographic photoconductor 1 is transferred by a transfer unit 6 onto a transfer material 7. The transfer material 7 having the transferred toner image is conveyed to a fixing unit 8, where the toner image is fixed, and the transfer material 7 is output from the electrophotographic apparatus. The electrophotographic apparatus may have a cleaning unit 9 configured to remove residual substances on the post-transfer surface of the electrophotographic photoconductor 1, such as residual toner. Alternatively, what is called, a cleanerless system without such an additional cleaning unit may be employed in which the residual substances are removed with the developing unit, for example. The electrophotographic apparatus may have a discharging mechanism of discharging the surface of the electrophotographic photoconductor 1 with pre-exposure light 10 emitted from a pre-exposure unit (not shown). A guiding unit 12 such as rails may be provided for attaching or detaching, to or from the main body of the electrophotographic apparatus, a process cartridge 11 according to an embodiment of the present disclosure.

An electrophotographic photoconductor according to an embodiment of the present disclosure is applicable to, for example, laser beam printers, LED printers, copiers, facsimiles, and multifunction apparatuses including the foregoing.

EXAMPLES

Hereinafter, the present disclosure will be described further in detail with reference to Examples and Comparative Examples. The present invention, within the spirit and scope thereof, is not limited to the following Examples at all. In the following description of Examples, "part" and "parts" are based on mass unless otherwise specified.

Methods for Producing Strontium Titanate Particles

Strontium titanate particles S-1 to S-4 were produced by the following methods.

Production Example of Particle S-1

An aqueous titanyl sulfate solution was hydrolyzed, and the resultant titanium hydroxide-containing slurry was rinsed with an alkaline aqueous solution. Subsequently, to the titanium hydroxide-containing slurry, hydrochloric acid was added such that the pH was adjusted to 0.7 to thereby obtain a titania sol dispersion liquid. To 2.2 mol (in terms of titanium oxide) of the titania sol dispersion liquid, an aqueous strontium chloride solution was added in a molar amount of 1.1 times the amount of the titania sol dispersion liquid. The resultant liquid was placed into a reaction vessel, and the reaction vessel was purged with nitrogen gas. Furthermore, pure water was added such that the concentration became 1.1 mol/L in terms of titanium oxide. Subsequently, the liquid was mixed by stirring, and heated at 90° C.; to this liquid under ultrasonic vibrations, 440 mL of a 10 N aqueous sodium hydroxide solution was added over 15 minutes, and then caused to react for 20 minutes. To the post-reaction slurry, pure water at 5° C. was added to achieve rapid cooling to 30° C. or less; and then the supernatant liquid was removed. Furthermore, to the slurry, an aqueous hydrochloric acid solution at pH 5.0 was added; the slurry was stirred for 1 hour and then rinsed with pure water repeatedly. Furthermore, the slurry was neutralized with sodium hydroxide, filtered through a Nutsche, and rinsed with pure water. The resultant cake was dried to obtain a particle S-1.

Production Example of Particle S-2

To 2.6 mol (in terms of titanium oxide) of the titania sol dispersion liquid, an aqueous strontium chloride solution was added in a molar amount of 1.0 times the amount of the titania sol dispersion liquid. The resultant liquid was placed into a reaction vessel, and the reaction vessel was purged with nitrogen gas. Furthermore, pure water was added such that the titanium oxide concentration became 1.3 mol/L. Subsequently, the liquid was mixed by stirring, and heated at 95° C.; to this liquid under ultrasonic vibrations, 300 mL of a 15 N aqueous sodium hydroxide solution was added over 5 minutes, and then caused to react for 20 minutes. To the post-reaction slurry, pure water at 5° C. was added to achieve rapid cooling to 30° C. or less; and then the supernatant liquid was removed. Furthermore, to the slurry, an aqueous hydrochloric acid solution at pH 5.0 was added; the slurry was stirred for 1 hour and then rinsed with pure water repeatedly. Furthermore, the slurry was neutralized with sodium hydroxide, filtered through a Nutsche, and rinsed with pure water. The resultant cake was dried to obtain a particle S-2.

Production Example of Particle S-3

To 0.6 mol (in terms of titanium oxide) of the titania sol dispersion liquid, an aqueous strontium chloride solution was added in a molar amount of 1.2 times the amount of the titania sol dispersion liquid. The resultant liquid was placed into a reaction vessel, and the reaction vessel was purged with nitrogen gas. Furthermore, pure water was added such that the titanium oxide concentration became 0.3 mol/L. Subsequently, the liquid was mixed by stirring, and heated at 80° C.; to this liquid, 750 mL of a 2 N aqueous sodium hydroxide solution was added over 480 minutes, and then caused to react for 20 minutes. The post-reaction slurry was cooled to 30° C. or less, and then the supernatant liquid was removed. Furthermore, the slurry was rinsed with pure water. The resultant cake was dried to obtain a particle S-3.

Production Example of Particle S-4

To 0.4 mol (in terms of titanium oxide) of the titania sol dispersion liquid, an aqueous strontium chloride solution was added in a molar amount of 1.2 times the amount of the titania sol dispersion liquid. The resultant liquid was placed into a reaction vessel, and the reaction vessel was purged with nitrogen gas. Furthermore, pure water was added such that the titanium oxide concentration became 0.2 mol/L. Subsequently, the liquid was mixed by stirring, and heated at 70° C.; to this liquid, 600 mL of a 2 N aqueous sodium hydroxide solution was added over 660 minutes, and then caused to react for 20 minutes. The post-reaction slurry was cooled to 30° C. or less, and then the supernatant liquid was removed. Furthermore, the slurry was rinsed with pure water. The resultant cake was dried to obtain a particle S-4.

The particles S-1 to S-4 produced above were each observed with a transmission electron microscope "H-800" (manufactured by Hitachi, Ltd.); in a field of view at a maximum magnification of 2,000,000, the lengths of 100 primary particles were measured; and the average particle diameter (number-average particle diameter) of the primary particles was determined. As a result, the particles S-1 to S-4 were respectively found to have an average particle diameter of 35 nm, 10 nm, 100 nm, and 150 nm.

Surface Treatment of Strontium Titanate Particles

Strontium titanate particles were surface-treated in the following manner to produce surface-treated strontium titanate particles S-1A to S-4A.

Production Example of Surface-Treated Particle S-1A

The particle S-1 (100 parts) produced above was mixed with 500 parts of toluene by stirring. To this, as a silane coupling agent, 2 parts of N-2-(aminoethyl)-3-aminopropylmethyldimethoxysilane (trade name: KBM602, manufactured by Shin-Etsu Chemical Co., Ltd.) was added. The resultant liquid was stirred for 6 hours. Subsequently, toluene was driven off under a reduced pressure. The residue was heat-dried at 130° C. for 6 hours to obtain a surface-treated particle S-1A.

Production Examples of Surface-Treated Particles S-2A to S-4A

Surface-treated particles S-2A to S-4A were produced as in the Production example of surface-treated particle S-1A except that the particle S-1 in the Production example of surface-treated particle S-1A was changed to particles S-2 to S-4.

Production of Electrophotographic Photoconductors

Example 1

Support Member

An aluminum cylinder having a diameter of 30 mm, a length of 357.5 mm, and a wall thickness of 1 mm was employed as the support member (conductive support member).

Undercoating Layer

The strontium titanate particle S-1A (120 parts), 36 parts of an alkyd resin (BECKOLITE M6401-50-S, manufactured by Dainippon Ink and Chemicals, solid content: 50%), 20 parts of a melamine resin (SUPER BECKAMINE G-821-60, manufactured by Dainippon Ink and Chemicals, solid content: 60%), and 170 parts of methyl ethyl ketone were mixed, and subjected to a dispersion treatment using a sand mill apparatus including glass beads having a diameter of 0.8 mm in an atmosphere at 23±3° C. for 10 hours, to obtain an undercoating-layer-forming coating liquid. The obtained undercoating-layer-forming coating liquid was applied onto the support member by immersion coating, and dried for 30 minutes at 140° C., to form an undercoating layer having a thickness of 3.5 μm.

Charge Generating Layer

Subsequently, 8 parts of a titanyl phthalocyanine pigment (titanyl phthalocyanine pigment having at least a maximum diffraction peak at 27.3° in a spectrum measured by Cu-Kα characteristic X-ray diffractometry), 5 parts of polyvinyl butyral (trade name: S-LEC BX-1, manufactured by SEKISUI CHEMICAL CO., LTD.), and 400 parts of 2-butanone were mixed. Subsequently, the mixture was subjected to a dispersion treatment using a sand mill including glass beads having a diameter of 1 mm in an atmosphere at 23±3° C. for 1 hour, to prepare a charge-generating-layer-forming coating liquid.

This charge-generating-layer-forming coating liquid was applied onto the undercoating layer by immersion coating. The resultant coating film was dried for 10 minutes at 90° C., to form a charge generating layer having a thickness of 0.3 μm.

Charge Transport Layer

A polycarbonate resin (Panlite TS-2050, manufactured by Teijin Chemicals Ltd., 100 parts), 100 parts of a charge transport material (4,4'-dimethyl-4"-(β-phenylstyryl)triphenylamine), 1 part of a compound represented by the following formula (1-1), 800 parts of tetrahydrofuran, and 1 part by mass of silicone oil KF-54 (manufactured by Shin-Etsu Chemical Co., Ltd.) were mixed to achieve dissolution to thereby obtain a charge-transport-layer-forming coating liquid. The obtained charge-transport-layer-forming coating liquid was applied onto the charge generating layer by immersion coating to form a coating film. The obtained coating film was dried for 60 minutes at 100° C., to form a charge transport layer having a thickness of 22 μm.

(1-1)

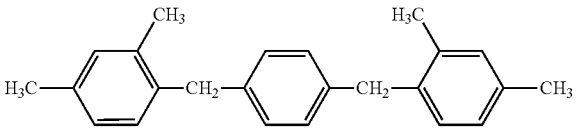

Protective Layer

α-alumina (trade name: Sumicorundum AA-03, manufactured by Sumitomo Chemical Company, Limited, 10 parts), 1 part of a dispersing agent (trade name: AL-10, manufactured by TAKEMOTO OIL & FAT Co., Ltd.), and 300.8 parts of tetrahydrofuran were mixed. Subsequently, the mixture was subjected to a dispersion treatment using a sand mill including glass beads having a diameter of 0.5 mm in an atmosphere at 23±3° C. for 6 hours, to obtain an α-alumina dispersion liquid.

Subsequently, 43 parts of a hole transport compound represented by the following formula (2), 21 parts of trimethylolpropane triacrylate (trade name: KAYARAD TMPTA, manufactured by Nippon Kayaku Co., Ltd.), 21 parts of caprolactone-modified dipentaerythritol hexaacrylate (trade name: KAYARAD DPCA-120, manufactured by Nippon Kayaku Co., Ltd.), 0.1 parts of a mixture of acryloyl group-containing polyester-modified polydimethylsiloxane and propoxy-modified 2-neopentyl glycol diacrylate (BYK-UV3570, manufactured by BYK-Chemie GmbH), 4 parts of 1-hydroxycyclohexyl phenyl ketone (IRGACURE 184, manufactured by Ciba Specialty Chemicals), and 100 parts of tetrahydrofuran were added to the above-described dispersion liquid, and filtered through a polyflon filter (trade name: PF-040, manufactured by ADVANTEC MFS, INC.), to prepare a protective-layer-forming coating liquid.

This protective-layer-forming coating liquid was applied onto the charge transport layer by immersion coating to form a coating film. The coating film was irradiated with ultraviolet radiation, in a nitrogen atmosphere, using a metal halide lamp, with a distance of 50 mm from the light source to the surface of the photoconductor, at a lamp output of 4 kW, for 2 minutes. The obtained coating film was dried for 5 minutes at 40° C., to form a protective layer (surface layer) having a thickness of 3.5 μm. In this way, an electrophotographic photoconductor including the protective layer was produced.

(2)

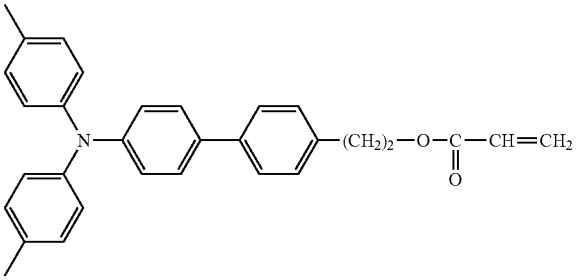

Example 2

An electrophotographic photoconductor of Example 2 was produced as in Example 1 except that, in the preparation of the undercoating-layer-forming coating liquid in Example 1, the amount of the alkyd resin (BECKOLITE M6401-50-S, manufactured by Dainippon Ink and Chemicals, solid content: 50%) was changed from 36 parts to 72 parts, and the amount of the melamine resin (SUPER BECKAMINE G-821-60, manufactured by Dainippon Ink and Chemicals, solid content: 60%) was changed from 20 parts to 40 parts.

Example 3

An electrophotographic photoconductor of Example 3 was produced as in Example 1 except that, in the preparation of the undercoating-layer-forming coating liquid in Example 1, the amount of the alkyd resin (BECKOLITE M6401-50-S, manufactured by Dainippon Ink and Chemicals, solid content: 50%) was changed from 36 parts to 24 parts, and the amount of the melamine resin (SUPER BECKAMINE G-821-60, manufactured by Dainippon Ink and Chemicals, solid content: 60%) was changed from 20 parts to 13.3 parts.

Example 4

An electrophotographic photoconductor of Example 4 was produced as in Example 1 except that, in the preparation of the undercoating-layer-forming coating liquid in Example 1, the amount of the alkyd resin (BECKOLITE M6401-50-S, manufactured by Dainippon Ink and Chemicals, solid content: 50%) was changed from 36 parts to 40 parts, and the amount of the melamine resin (SUPER BECKAMINE G-821-60, manufactured by Dainippon Ink and Chemicals, solid content: 60%) was changed from 20 parts to 16.7 parts.

Example 5

An electrophotographic photoconductor of Example 5 was produced as in Example 1 except that, in the preparation of the undercoating-layer-forming coating liquid in Example 1, the amount of the alkyd resin (BECKOLITE M6401-50-S, manufactured by Dainippon Ink and Chemicals, solid content: 50%) was changed from 36 parts to 27.3 parts, and the amount of the melamine resin (SUPER BECKAMINE G-821-60, manufactured by Dainippon Ink and Chemicals, solid content: 60%) was changed from 20 parts to 27.3 parts.

Example 6

An electrophotographic photoconductor of Example 6 was produced as in Example 1 except that, in the preparation of the undercoating-layer-forming coating liquid in Example 1, the strontium titanate particle S-1A was changed to the strontium titanate particle S-2A.

Example 7

An electrophotographic photoconductor of Example 7 was produced as in Example 1 except that, in the preparation of the undercoating-layer-forming coating liquid in Example 1, the strontium titanate particle S-1A was changed to the strontium titanate particle S-3A.

Example 8

Support Member

An aluminum cylinder having a diameter of 30 mm, a length of 357.5 mm, and a wall thickness of 1 mm was employed as the support member (conductive support member).

Charge Blocking Layer

N-methoxymethylated nylon (FINE RESIN FR-101, manufactured by Namariichi Co., Ltd., 4 parts), 70 parts of methanol, and 30 parts of n-butanol were mixed to obtain a charge-blocking-layer-forming coating liquid. The obtained charge-blocking-layer-forming coating liquid was applied onto the support member by immersion coating, and dried for 10 minutes at 130° C., to form a charge blocking layer having a thickness of 0.7 μm.

Undercoating Layer, Charge Generating Layer, Charge Transport Layer, and Protective Layer An undercoating-layer-forming coating liquid was obtained as in Example 1. The obtained undercoating-layer-forming coating liquid was applied onto the charge blocking layer by immersion coating, and dried for 30 minutes at 140° C., to form an undercoating layer having a thickness of 3.5 μm. Subsequently, on the undercoating layer, a charge generating layer, a charge transport layer, and a protective layer were sequentially formed as in Example 1, to produce an electrophotographic photoconductor of Example 8.

Example 9

An electrophotographic photoconductor of Example 9 was produced as in Example 1 except that, in the preparation of the undercoating-layer-forming coating liquid in Example 1, the strontium titanate particle S-1A was changed to the strontium titanate particle S-1.

Example 10

The strontium titanate particle S-1A (96 parts), 24 parts of a rutile-type titanium oxide particle (CR-EL, manufactured by ISHIHARA SANGYO KAISHA, LTD., average particle diameter: 250 nm), 36 parts of an alkyd resin (BECKOLITE M6401-50-S, manufactured by Dainippon Ink and Chemicals, solid content: 50%), 20 parts of a melamine resin (SUPER BECKAMINE G-821-60, manufactured by Dainippon Ink and Chemicals, solid content: 60%), and 170 parts of methyl ethyl ketone were mixed, and subjected to a dispersion treatment using a sand mill apparatus including glass beads having a diameter of 0.8 mm in an atmosphere at 23±3° C. for 10 hours, to obtain an undercoating-layer-forming coating liquid. An electrophotographic photoconductor of Example 10 was produced as in Example 1 except that the obtained undercoating-layer-forming coating liquid was used to form an undercoating layer.

Example 11

An undercoating-layer-forming coating liquid was obtained as in Example 1 except that, in the preparation of the undercoating-layer-forming coating liquid in Example 10, the strontium titanate particle S-1A was changed to the strontium titanate particle S-3A, the amount of the alkyd resin (BECKOLITE M6401-50-S, manufactured by Dainippon Ink and Chemicals, solid content: 50%) was changed from 36 parts to 54.7 parts, and the amount of the melamine resin (SUPER BECKAMINE G-821-60, manufactured by Dainippon Ink and Chemicals, solid content: 60%) was changed from 20 parts to 54.7 parts. An electrophotographic photoconductor of Example 11 was produced as in Example 10 except that the obtained undercoating-layer-forming coating liquid was used to form an undercoating layer.

Example 12

An undercoating-layer-forming coating liquid was obtained as in Example 11. An electrophotographic photoconductor of Example 12 was produced as in Example 8 except that the obtained undercoating-layer-forming coating liquid was used to form an undercoating layer.

Example 13

A polycarbonate resin (Panlite TS-2050, manufactured by Teijin Chemicals Ltd., 100 parts), 100 parts of a charge transport material (4,4'-dimethyl-4"-(β-phenylstyryl)triphenylamine), 800 parts of tetrahydrofuran, and 1 part by mass of silicone oil KF-54 (manufactured by Shin-Etsu Chemical Co., Ltd.) were mixed to achieve dissolution, to obtain a charge-transport-layer-forming coating liquid. An electrophotographic photoconductor of Example 13 was produced as in Example 1 except that the obtained charge-transport-layer-forming coating liquid was used to form a charge transport layer.

Example 14

An electrophotographic photoconductor of Example 14 was produced as in Example 1 except that, in the preparation of the undercoating-layer-forming coating liquid in Example 1, the strontium titanate particle S-1A was changed to the strontium titanate particle S-4A.

Example 15

An electrophotographic photoconductor of Example 15 was produced as in Example 1 except that, in the preparation of the undercoating-layer-forming coating liquid in Example 1, the amount of the alkyd resin (BECKOLITE M6401-50-S, manufactured by Dainippon Ink and Chemicals, solid content: 50%) was changed from 36 parts to 48 parts, and the amount of the melamine resin (SUPER BECKAMINE G-821-60, manufactured by Dainippon Ink and Chemicals, solid content: 60%) was changed from 20 parts to 10 parts.

Example 16

An electrophotographic photoconductor of Example 16 was produced as in Example 1 except that, in the preparation of the undercoating-layer-forming coating liquid in Example 1, the amount of the alkyd resin (BECKOLITE M6401-50-S, manufactured by Dainippon Ink and Chemicals, solid content: 50%) was changed from 36 parts to 24 parts, and the amount of the melamine resin (SUPER BECKAMINE G-821-60, manufactured by Dainippon Ink and Chemicals, solid content: 60%) was changed from 20 parts to 30 parts.

Example 17

An electrophotographic photoconductor of Example 17 was produced as in Example 1 except that, in the preparation of the undercoating-layer-forming coating liquid in Example 1, the amount of the alkyd resin (BECKOLITE M6401-50-S, manufactured by Dainippon Ink and Chemicals, solid content: 50%) was changed from 36 parts to 96 parts, and the amount of the melamine resin (SUPER BECKAMINE G-821-60, manufactured by Dainippon Ink and Chemicals, solid content: 60%) was changed from 20 parts to 53.3 parts.

Example 18

An electrophotographic photoconductor of Example 18 was produced as in Example 1 except that, in the preparation of the undercoating-layer-forming coating liquid in Example 1, the amount of the alkyd resin (BECKOLITE M6401-50-S, manufactured by Dainippon Ink and Chemicals, solid content: 50%) was changed from 36 parts to 18 parts, and the amount of the melamine resin (SUPER BECKAMINE G-821-60, manufactured by Dainippon Ink and Chemicals, solid content: 60%) was changed from 20 parts to 10 parts.

Example 19

An undercoating-layer-forming coating liquid was obtained as in Example 10 except that, in the preparation of the undercoating-layer-forming coating liquid in Example 10, the amount of the strontium titanate particle S-1A was changed from 96 parts to 72 parts, and the amount of the rutile-type titanium oxide particle (CR-EL, manufactured by ISHIHARA SANGYO KAISHA, LTD., average particle diameter: 250 nm) was changed from 24 parts to 48 parts. An electrophotographic photoconductor of Example 19 was produced as in Example 10 except that the obtained undercoating-layer-forming coating liquid was used to form an undercoating layer.

Comparative Example 1

A rutile-type titanium oxide particle (CR-EL, manufactured by ISHIHARA SANGYO KAISHA, LTD., average particle diameter: 250 nm, 120 parts), 36 parts of an alkyd resin (BECKOLITE M6401-50-S, manufactured by Dainippon Ink and Chemicals, solid content: 50%), 20 parts of a melamine resin (SUPER BECKAMINE G-821-60, manufactured by Dainippon Ink and Chemicals, solid content: 60%), and 170 parts of methyl ethyl ketone were mixed, and subjected to a dispersion treatment using a sand mill apparatus including glass beads having a diameter of 0.8 mm in an atmosphere at 23±3° C. for 10 hours, to obtain an undercoating-layer-forming coating liquid. An electrophotographic photoconductor of Comparative Example 1 was produced as in Example 13 except that the obtained undercoating-layer-forming coating liquid was used to form an undercoating layer.

Comparative Example 2

A rutile-type titanium oxide particle (CR-EL, manufactured by ISHIHARA SANGYO KAISHA, LTD., average particle diameter: 250 nm, 120 parts), 36 parts of an alkyd resin (BECKOLITE M6401-50-S, manufactured by Dainippon Ink and Chemicals, solid content: 50%), 20 parts of a melamine resin (SUPER BECKAMINE G-821-60, manufactured by Dainippon Ink and Chemicals, solid content: 60%), 1 part of ethylene glycol monoisopropyl ether, and 170 parts of methyl ethyl ketone were mixed, and subjected to a dispersion treatment using a sand mill apparatus including glass beads having a diameter of 0.8 mm in an atmosphere at 23±3° C. for 10 hours, to obtain an undercoating-layer-forming coating liquid. An electrophotographic photoconductor of Comparative Example 2 was produced as in Comparative Example 1 except that the obtained undercoating-layer-forming coating liquid was used to form an undercoating layer.

Comparative Example 3

A rutile-type titanium oxide particle (CR-EL, manufactured by ISHIHARA SANGYO KAISHA, LTD., average particle diameter: 250 nm, 112 parts), 56 parts of an anatase-type titanium oxide particle (NanoTek TiO2, manufactured by C. I. Kasei Company, Limited, average particle diameter: 40 nm), 36 parts of an alkyd resin (BECKOLITE M6401-50-S, manufactured by Dainippon Ink and Chemicals, solid content: 50%), 20 parts of a melamine resin (SUPER BECKAMINE G-821-60, manufactured by Dainippon Ink and Chemicals, solid content: 60%), and 170 parts of methyl ethyl ketone were mixed, and subjected to a dispersion treatment using a sand mill apparatus including glass beads having a diameter of 0.8 mm in an atmosphere at 23±3° C. for 10 hours, to obtain an undercoating-layer-forming coating liquid. An electrophotographic photoconductor of Comparative Example 3 was produced as in Comparative Example 1 except that the obtained undercoating-layer-forming coating liquid was used to form an undercoating layer.

Comparative Example 4

A rutile-type titanium oxide particle (MT150W JR, manufactured by Tayca Corporation, average particle diameter: 20 nm, 120 parts), 36 parts of an alkyd resin (BECKOLITE M6401-50-S, manufactured by Dainippon Ink and Chemicals, solid content: 50%), 20 parts of a melamine resin (SUPER BECKAMINE G-821-60, manufactured by Dainippon Ink and Chemicals, solid content: 60%), and 170 parts of methyl ethyl ketone were mixed, and subjected to a dispersion treatment using a sand mill apparatus including glass beads having a diameter of 0.8 mm in an atmosphere at 23±3° C. for 10 hours, to obtain an undercoating-layer-forming coating liquid. An electrophotographic photoconductor of Comparative Example 4 was produced as in Comparative Example 1 except that the obtained undercoating-layer-forming coating liquid was used to form an undercoating layer.

Comparative Example 5

An anatase-type titanium oxide particle (NanoTek TiO2, manufactured by C. I. Kasei Company, Limited, average particle diameter: 40 nm, 120 parts), 36 parts of an alkyd resin (BECKOLITE M6401-50-S, manufactured by Dainippon Ink and Chemicals, solid content: 50%), 20 parts of a melamine resin (SUPER BECKAMINE G-821-60, manufactured by Dainippon Ink and Chemicals, solid content: 60%), and 170 parts of methyl ethyl ketone were mixed, and subjected to a dispersion treatment using a sand mill apparatus including glass beads having a diameter of 0.8 mm in an atmosphere at 23±3° C. for 10 hours, to obtain an undercoating-layer-forming coating liquid. An electrophotographic photoconductor of Comparative Example 5 was produced as in Comparative Example 1 except that the obtained undercoating-layer-forming coating liquid was used to form an undercoating layer.

Comparative Example 6

As in Example 8, a charge blocking layer was formed on a support member. As in Comparative Example 1, an undercoating-layer-forming coating liquid was obtained. The obtained undercoating-layer-forming coating liquid was applied onto the charge blocking layer by immersion coating, and dried for 30 minutes at 140° C., to form an undercoating layer having a thickness of 3.5 μm. Subsequently, on the undercoating layer, a charge generating layer, a charge transport layer, and a protective layer were sequentially formed as in Example 13, to produce an electrophotographic photoconductor of Comparative Example 6.

Comparative Example 7

As in Comparative Example 1, an undercoating-layer-forming coating liquid was obtained. An electrophotographic photoconductor of Comparative Example 7 was produced as in Example 1 except that the obtained undercoating-layer-forming coating liquid was used to form an undercoating layer.

Evaluations

The electrophotographic photoconductors of Examples 1 to 19 and Comparative Examples 1 to 7 were evaluated, in the following manner, in terms of residual potential during repeated use. The evaluation apparatus employed was an electrophotographic apparatus that was a modified apparatus of a copier (trade name: iR-ADV C5051, manufactured by CANON KABUSHIKI KAISHA). The cyan station of the evaluation apparatus was used for the evaluations. During the evaluations, the evaluation apparatus was installed in an environment at a temperature of 23° C. and at a humidity of 5% RH. The charging unit was configured to apply a voltage of alternating current voltage superimposed on direct current voltage to the charging roller. The surface potential of such an electrophotographic photoconductor was measured by detaching the development cartridge from the evaluation apparatus, and a potential measurement instrument was inserted into the development cartridge. The potential measurement instrument was disposed such that its potential measurement probe was positioned at the development position of the development cartridge. The potential measurement probe was positioned at the center (in the generatrix direction) of the electrophotographic photoconductor.

The voltage applied to the charging roller and the exposure light amount of the exposure unit were first adjusted such that the electrophotographic photoconductor had an initial dark area potential Vd of −900 [V] and an initial light area potential Vl of −300 [V].

Subsequently, 5000 images of a test chart having an image percentage of 5% were continuously formed, and then the residual potential Vr of the electrophotographic photoconductor was measured.

When the absolute value |Vr| of the residual potential Vr measured under the above-described evaluation conditions was 100 V or less, the residual potential was evaluated as grade A; when the absolute value |Vr| was 120 V or less, the residual potential was evaluated as grade B; and when the absolute value |Vr| was more than 120 V, the residual potential was evaluated as grade C. The evaluation results are described in Table 1.

TABLE 1

Evaluation results

| Example No. | Residual potential |Vr| (V) | Residual potential Grade |
|---|---|---|
| Example 1 | 82 | A |
| Example 2 | 90 | A |
| Example 3 | 83 | A |
| Example 4 | 86 | A |
| Example 5 | 89 | A |
| Example 6 | 86 | A |
| Example 7 | 89 | A |
| Example 8 | 88 | A |
| Example 9 | 84 | A |
| Example 10 | 88 | A |
| Example 11 | 102 | B |
| Example 12 | 104 | B |
| Example 13 | 87 | A |
| Example 14 | 106 | B |
| Example 15 | 91 | A |
| Example 16 | 105 | B |
| Example 17 | 108 | B |
| Example 18 | 91 | A |
| Example 19 | 113 | B |
| Comparative Example 1 | 128 | C |
| Comparative Example 2 | 129 | C |
| Comparative Example 3 | 127 | C |
| Comparative Example 4 | 127 | C |
| Comparative Example 5 | 127 | C |
| Comparative Example 6 | 132 | C |
| Comparative Example 7 | 126 | C |

The present disclosure provides an electrophotographic photoconductor in which an increase in the residual potential during repeated use is suppressed. The present disclosure also provides a process cartridge and an electrophotographic apparatus that include the electrophotographic photoconductor.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-201212, filed Oct. 25, 2018, which is hereby incorporated by reference herein in its entirety.

What is claimed is:

1. An electrophotographic photoconductor comprising, in sequence:

a support member;

an undercoating layer containing a binder resin and an inorganic particle; and a photosensitive layer containing a compound represented by formula (1)

(1)

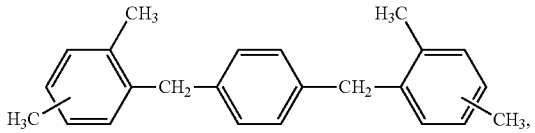

wherein the binder resin of the undercoating layer is an alkyd-melamine resin, and the inorganic particle of the undercoating layer contains a strontium titanate particle.

2. The electrophotographic photoconductor according to claim 1, wherein, in the undercoating layer, a mass ratio of an amount of the strontium titanate particle to a total amount of the inorganic particle is 0.8 or more and 1.0 or less.

3. The electrophotographic photoconductor according to claim 1, wherein, in the undercoating layer, a mass content ratio of the inorganic particle to the alkyd-melamine resin is 2.0 or more and 6.0 or less.

4. The electrophotographic photoconductor according to claim 1, wherein, in the alkyd-melamine resin of the undercoating layer, a mass ratio of an amount of a melamine resin to a total amount of an alkyd resin is 0.5 or more and 1.2 or less.

5. The electrophotographic photoconductor according to claim 1, wherein, in the undercoating layer, the strontium titanate particle has an average primary particle diameter of 10 nm or more and 100 nm or less.

6. The electrophotographic photoconductor according to claim 1, wherein, in the undercoating layer, a mass ratio of an amount of the strontium titanate particle to a total amount of the inorganic particle is 0.8 or more and 1.0 or less and a mass content ratio of the inorganic particle to the alkyd-melamine resin is 2.0 or more and 6.0 or less.

7. A process cartridge supporting collectively an electrophotographic photoconductor and at least one unit selected from the group consisting of a charging unit, a developing unit, a transfer unit, a discharging unit, and a cleaning unit, and being configured to be detachably attached to a main body of an electrophotographic apparatus, wherein the electrophotographic photoconductor includes, in sequence:

a support member;

an undercoating layer containing a binder resin and an inorganic particle; and a photosensitive layer containing a compound represented by formula (1)

(1)

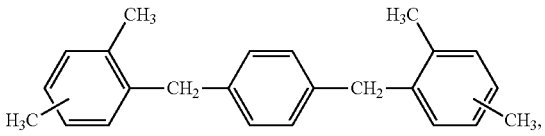

the binder resin of the undercoating layer is an alkyd-melamine resin, and the inorganic particle of the undercoating layer contains a strontium titanate particle.

8. The process cartridge according to claim 7, wherein, in the undercoating layer, a mass ratio of an amount of the strontium titanate particle to a total amount of the inorganic particle is 0.8 or more and 1.0 or less and a mass content ratio of the inorganic particle to the alkyd-melamine resin is 2.0 or more and 6.0 or less.

9. An electrophotographic apparatus comprising:

an electrophotographic photoconductor;

a charging unit;

an exposure unit;

a developing unit; and a transfer unit, wherein the electrophotographic photoconductor includes, in sequence:

a support member;

an undercoating layer containing a binder resin and an inorganic particle; and a photosensitive layer containing a compound represented by formula (1)

(1)

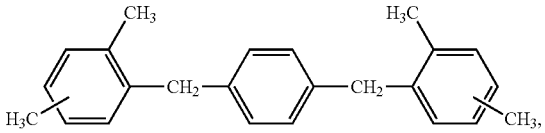

the binder resin of the undercoating layer is an alkyd-melamine resin, and the inorganic particle of the undercoating layer contains a strontium titanate particle.

10. The electrophotographic apparatus according to claim 9, wherein, in the undercoating layer, a mass ratio of an amount of the strontium titanate particle to a total amount of the inorganic particle is 0.8 or more and 1.0 or less and a mass content ratio of the inorganic particle to the alkyd-melamine resin is 2.0 or more and 6.0 or less.

* * * * *